United States Patent [19]

O'Neal et al.

[11] Patent Number: 4,856,439

[45] Date of Patent: Aug. 15, 1989

[54] APPARATUS FOR MANUFACTURING PILLOWCASES

[76] Inventors: Darrell D. O'Neal, 2081 Merle Dr., Conyers, Ga. 30207; Parks C. Stewart, 1005 Winding Creek Trail, Atlanta, Ga. 30328

[21] Appl. No.: 233,466

[22] Filed: Aug. 18, 1988

[51] Int. Cl.[4] ..... D05B 13/00

[52] U.S. Cl. ..... 112/10; 112/121.15; 112/121.29; 112/307

[58] Field of Search ..... 112/10, 2, 121.11, 121.12, 112/121.15, 121.29, 304, 307, 130

[56] References Cited

U.S. PATENT DOCUMENTS

| | | | |
|---|---|---|---|
| 2,667,132 | 1/1954 | Golden | 112/10 |
| 2,940,404 | 6/1960 | Damon | 112/10 |
| 3,126,848 | 3/1964 | Gastonquay | 112/10 |
| 4,224,883 | 9/1980 | Zeigler, Jr. et al. | 112/307 X |
| 4,754,717 | 7/1988 | Henze et al. | 112/121.12 X |

*Primary Examiner*—H. Hampton Hunter

*Attorney, Agent, or Firm*—Jones, Askew & Lunsford

[57] ABSTRACT

In a method and apparatus for constructing pillowcases, upper and lower layers of fabric are conveyed along separate paths with their obverse surfaces facing upwardly. Cuffs are formed along one longitudinal edge of each layer. The upper layer of fabric is then reversed to an obverse-side down orientation, and the upper and lower layers of fabric are superimposed with their obverse surfaces mutually facing and their cuffed lateral edges mutually corresponding. The superimposed upper and lower layers of fabric are then stitched together along the lateral edge opposite the cuffed lateral edge. Next, a length of the superimposed upper and lower layers of fabric is cut to a length equal to the desired width of a finished pillowcase. The resulting rectangular workpiece comprises upper and lower panels of fabric stitched together along one transverse edge and cuffed at their opposite transverse edge. Next, the upper and lower panels of fabric are stitched together along their corresponding longitudinal edges, such that the workpiece is sewn closed along one transverse edge and both longitudinal edges and is cuffed at the open transverse edge. Finally, the workpiece is turned inside out so that the cuffs and the obverse surfaces of the fabric face outwardly and the seams are concealed.

8 Claims, 2 Drawing Sheets

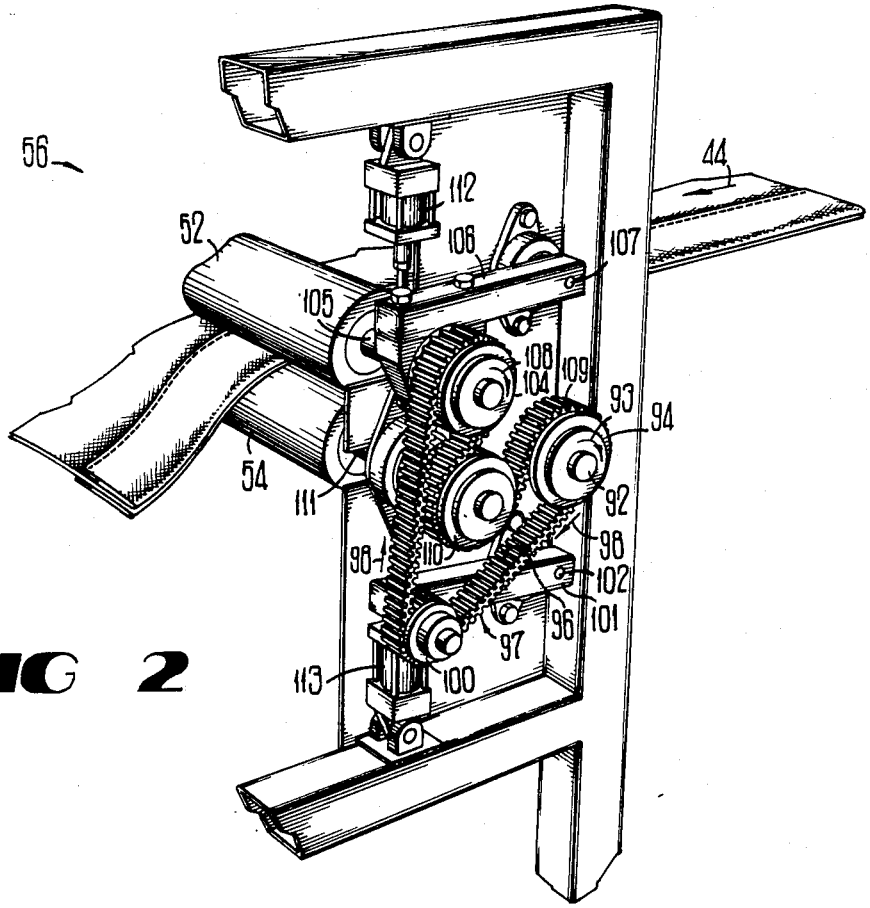
FIG 2
FIG 3
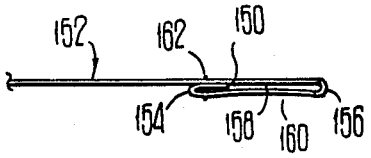
FIG 4
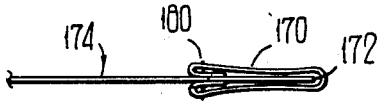

APPARATUS FOR MANUFACTURING PILLOWCASES

TECHNICAL FIELD

The present invention relates generally to methods and apparatus for manufacturing textiles, and relates more specifically to a method and apparatus for manufacturing pillowcases and the like.

BACKGROUND OF THE INVENTION

Pillowcases of conventional construction are well known and comprise a rectangular bag, closed on three of its four sides and open on the remaining side (usually a transverse edge) to permit a pillow to be inserted into and withdrawn from the pillowcase. A decorative cuff, formed either by folding the edge of the material onto itself or by attaching a cuff of a separate, complementary material, is formed around the open end of the pillowcase.

Conventional methods and apparatus for manufacturing pillowcases all involve forming the pillowcase out of a single piece of fabric which is folded in half at some point during the manufacturing process. The resulting fold forms one of the three closed sides. The fold may be disposed along a transverse edge, with the adjacent longitudinal sides stitched closed; or the fold may be disposed along one longitudinal edge, with the remaining longitudinal edge and a transverse edge stitched closed.

There are basically three different methods known in the prior art for manufacturing pillowcases on a mass-production basis. In one method, an elongated piece of fabric having a width approximately equal to twice the length of a finished pillowcase is conveyed along a predetermined path. Cuffs are formed and chain-stitched along the two lateral edges of the fabric, and the fabric is folded along its longitudinal center line to bring its cuffed edges together. A length of the folded fabric is fed through a cutting station and cut to a length approximately equal to the width of a finished pillowcase. The cut length of folded fabric comprises a rectangular workpiece having a fold along one transverse edge and a cuff along the remaining transverse edge. The longitudinal edges of the rectangular workpiece are then stitched closed, and the stitched workpiece is turned inside out to reveal the cuff and conceal the seams of the pillowcase.

In a second method, an elongated piece of fabric having a width approximately equal to the desired length of a finished pillowcase is conveyed along a predetermined path. A cuff is formed along one lateral edge of the fabric, and the cuffed fabric is fed and cut to a length equal to twice the desired width of a finished pillowcase. The resulting rectangular panel is folded along the center line perpendicular to the cuffed edge to form a rectangular workpiece which is cuffed along one transverse edge and folded along one longitudinal edge. The remaining longitudinal edge is stitched closed, and then the remaining transverse edge is stitched closed. Finally, the workpiece is turned inside out to complete the manufacturing process.

In a third method, a piece of fabric having a width equal to twice the width of a finished pillowcase is fed and cut to a length which is the width of a cuff longer than the desired length of the finished pillowcase. A cuff is formed across the width of the fabric, and the fabric is then folded along a center line perpendicular to the cuffed edge. The resulting rectangular workpiece has a cuff along one transverse edge and is folded along one longitudinal edge. The remaining transverse edge is stitched closed, and then the remaining longitudinal edge is stitched closed. Again, the manufacturing process is completed by turning the workpiece inside out. The pillowcase formed by this third method is similar to the pillowcase formed by the previously described second method in that the resulting pillowcase is folded along one longitudinal edge and stitched closed along the opposite longitudinal edge and one transverse edge. However, the products of these two processes differ in that a pattern or print which runs the length of the raw fabric will run parallel to the cuff in the pillowcase of the second method, but will run perpendicular to the cuff in a pillowcase constructed by the third method.

Whichever of these three prior art methods is used, the step of folding the material in half is the single most demanding step to accomplish, since it is very difficult to align the edges of the folded panels accurately with one another. Further, apparatus for performing this folding step is expensive to manufacture, requires a considerable number of moving parts, and is a high-maintenance item.

SUMMARY OF THE INVENTION

As will be seen, the present invention overcomes these and other disadvantages associated with the prior art method and apparatus for constructing pillowcases. Stated generally, the present invention comprises a simplified method and apparatus for constructing pillowcases which eliminates the step of folding the panel of fabric in half, consequently eliminating the problems associated with aligning the edges of the folded panels accurately with one another. The apparatus for accomplishing the method is much less expensive to manufacture than prior art apparatus, requires less maintenance, contains substantially fewer moving parts, and is more reliable.

Stated somewhat more specifically, the present invention comprises a method and apparatus for forming cuffs along the lateral edges of two separate elongated pieces of fabric. The pieces of fabric are brought together with their cuffed, obverse surfaces mutually facing and are stitched together along their lateral edges opposite the cuffed edges. The two joined pieces of fabric are fed and cut to a length equal to the width of a finished pillowcase, forming a rectangular workpiece having one transverse edge stitched together and the remaining transverse edge cuffed. The longitudinal edges of the workpiece are stitched together, and the workpiece is then turned inside out. The resulting pillowcase is cuffed along one transverse edge and is stitched closed along the remaining transverse edge and both longitudinal edges.

Stated more particularly, the present invention comprises a first frame for holding a roll of fabric for rotation thereon. A first layer of fabric is drawn off the first roll with its obverse surface disposed upwardly and is conveyed along a predetermined path. A cuff is formed along one lateral edge of the layer of fabric, either by folding the lateral edge of the fabric over onto itself or by forming a cuff from a separate, complementary piece of fabric. The cuff is stitched in place by drawing the layer of fabric through a chain-stitch sewing machine.

Simultaneously, a second layer of fabric is being drawn obverse surface up along a second path from a second roll of fabric supported on a second frame. In the same manner as previously described with respect to the first layer, a cuff is formed and stitched along one lateral edge of the second layer of fabric.

Next, the first and second layers of fabric are brought together with their obverse surfaces mutually facing and with their cuffed lateral edges corresponding. In order to accomplish this juxtaposition, the upper of the two layers of fabric must be reversed so that its obverse side is facing downwardly toward the lower layer. In the disclosed embodiment, this reversal is accomplished by wrapping the upper layer around a breakover bar.

The first and second layers of fabric are then conveyed together in mutually facing juxtaposition along a path parallel to their cuffed lateral edges. A chain-stitch sewing machine disposed along the path stitches the mutually facing upper and lower layers of fabric together along their lateral edges opposite the cuffed lateral edge. The upper and lower layers of fabric are then fed and cut to a length equal to the desired width of a finished pillowcase to form a rectangular workpiece. The resulting rectangular workpiece comprises upper and lower fabric panels stitched together along one transverse edge and cuffed along the remaining transverse edge.

The rectangular workpiece is then conveyed in a direction perpendicular to its transverse edges. As the workpiece is conveyed along this path, the upper and lower panels of the rectangular workpiece are stitched together along their longitudinal edges by a pair of overedge sewing machines disposed along opposite sides of the path. Finally, the rectangular workpiece, stitched along both lateral edges and one transverse edge and cuffed along the remaining transverse edge, is manually turned inside out to reveal the cuffs and the finish sides of the fabric panels and to conceal the hems.

Thus, it is an object of the present invention to provide an improved method and apparatus for manufacturing pillowcases.

It is a further object of the present invention to provide an apparatus for manufacturing pillowcases which comprises a reduced number of moving parts, is less expensive to manufacture, and provides enhanced reliability.

Other objects, features, and advantages of the present invention will become apparent upon reading the following specification when taken in conjunction with the drawings and the appended claims.

BRIEF DESCRIPTION OF THE DRAWINGS

FIG. 2 is a perspective view of a drive mechanism for a material pull station of the apparatus of FIG. 1.

FIG. 3 is an edge view of a first embodiment of a cuff structure for a pillowcase constructed according to the method of the present invention.

FIG. 4 is an edge view of a second embodiment of a cuff structure for a pillowcase constructed according to the method of the present invention.

DETAILED DESCRIPTION OF THE DISCLOSED EMBODIMENT

Figure 1:
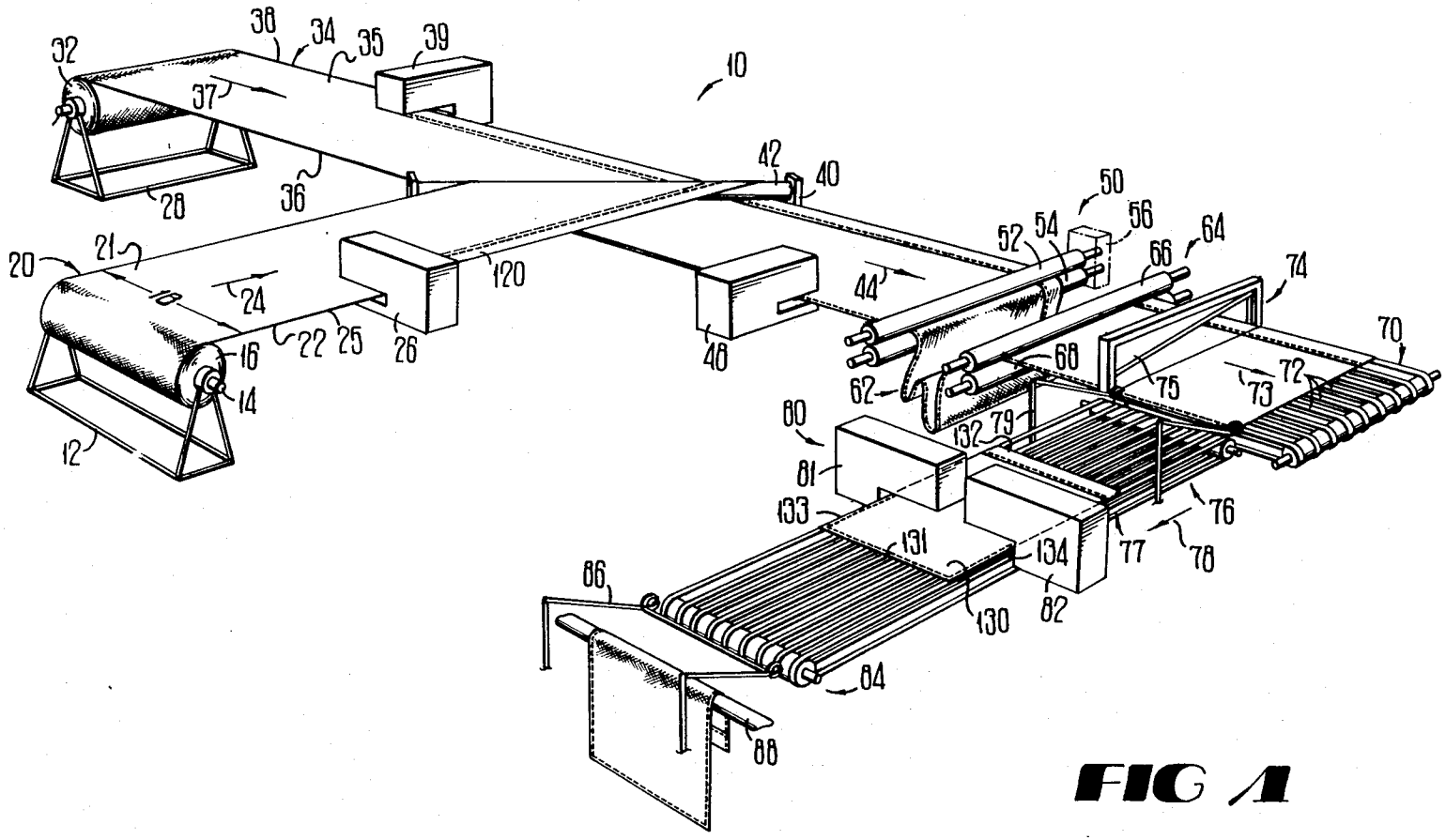
FIG. 1 is a perspective view of a pillowcase manufacturing apparatus according to the present invention.

Referring now in more detail to the drawings, in which like numerals indicate like elements throughout the several views, FIG. 1 shows a pillowcase-manufacturing apparatus 10 according to the present invention. The apparatus 10 includes a first frame 12 having a spindle 14 for holding a first roll of fabric 16 thereon. The first roll of fabric 16 has a width 18 substantially equal to the desired length of a finished pillowcase. A layer of fabric 20 is drawn off the first roll 16 and comprises obverse and reverse surfaces, 21 and 22 respectively. For those fabrics which have a finished and an unfinished side, such as printed fabrics or nap fabrics, the obverse surface 21 will be understood to be the finished side of the fabric. For other fabrics which do not have an unfinished side, the obverse surface may comprise either side of the fabric. The first layer of fabric 20 is conveyed along a path in the direction indicated by the arrow 24 with its obverse surface 21 facing upwardly. The path along which the first layer 20 is conveyed is such that a lateral edge 25 of the first layer is drawn beneath a chain-stitch sewing machine 26. The chain stitch machine 26 is of conventional design well known to those skilled in the art and includes a hem-turning attachment (not shown).

The apparatus 10 further includes a second frame 28 comprising a spindle 30 for holding a second roll of fabric 32 for rotation thereon. The second roll of fabric 32 is of the same width as the first roll of fabric 16. A second layer of fabric 34 comprising obverse and reverse surfaces 35, 36 is drawn off the second roll 32 and conveyed along a path in the direction indicated by the arrow 37 with its obverse side 35 facing upwardly. The path along which the second layer 34 is conveyed is such that a lateral edge 38 of the second layer is drawn beneath a second chain-stitch sewing machine 39, again including a hem-turning attachment.

The frames 12, 28 further comprise edge-guiding apparatus of conventional design to control the location of the fabric rolls along their axes of rotation. Since such fabric rolls often are wrapped not in a uniform manner but rather in a manner in which the edges of the roll assume a "telescoping" or contoured profile, the edge of a layer of fabric may tend to move as the roll is unwrapped. To compensate for such variations, the edge-guiding apparatus senses the location of the edge of the fabric. As the roll unwinds, if the edge of the fabric begins to move off-line, the edge-guiding apparatus moves the roll along its axis of rotation as needed to return the fabric edge to the desired path.

A frame 40 supports a breakover bar 42 disposed in the path of the layer of fabric 20 and set at a 45° angle thereto. The layer of fabric 20 is wrapped around the breakover bar 42, reversing the first layer of fabric from an orientation where the obverse side 21 faces upwardly to an orientation where the reverse side 22 is facing upwardly. Passing the first layer of fabric 20 around the breakover bar 42 also alters the direction of travel of the first layer by 90° to coincide with the path of the second layer of fabric. The height of the breakover bar 42 is such that the lower edge of the breakover bar lies in the same plane as the path of the second layer of fabric 34.

After passing around the breakover bar 42, the first layer of fabric 20 follows a path coincident to the path of the second layer of fabric 34 in a direction indicated by the arrow 44. An overedge sewing machine 48 of conventional design is disposed along this path.

The upper and lower layers of fabric 20, 34 are drawn along their paths of travel by a material pull station, shown generally at 50. The material pull station 50 comprises upper and lower tangential rollers 52, 54 counterrotationally driven to pull the upper and lower layers of fabric 20, 34 therebetween. The upper and lower rollers are driven by a drive mechanism, shown generally at 56, which will be more particularly described below.

Just beyond the material pull station 50 is a fabric accumulator station 62 and a feed-to-length station 64. The feed-to-length station 64 comprises upper and lower tangential drive rollers 66, 68 counterrotationally driven to pull the upper and lower layers of fabric 20, 34 therebetween. However, whereas the drive rollers 52, 54 of the material pull station 50 are driven at a constant rate to pull the layers of fabric steadily along their path to the fabric accumulator station 62, the drive rollers 66, 68 of the feed-to-length station 64 are servo-controlled to draw only a predetermined length of fabric therebetween, and to stop when the predetermined length of fabric has been fed out. Servo-controlled feed-to-length apparatus are well within the level of skill of the art and will require no further explanation.

The feed-to-length station 64 measures the desired length of fabric onto a feed table, shown generally at 70. The feed table 70 comprises a support surface having a plurality of conveyor belts 72 running thereupon in the direction along which the fabric is fed, indicated by the arrow 73. To ensure that the fabric fed out by the feed-to-length station 64 feeds smoothly onto the feed table 70 rather than bunching up, the plurality of conveyor belts 72 run at a linear speed as fast as or slightly faster than the speed at which fabric is being fed out onto the feed table. The conveyor belts 72 are controlled to operate as the drive rollers of the feed-to-length station feed material onto the feed table. As the servo-controlled drive rollers stop, a clutch-type brake (not shown) stops the conveyor belts 72 concurrently therewith.

A cutting station 74 is disposed between the feed-to-length station 64 and the feed table 70 and includes a guillotine-type blade 75 for cutting the fed fabric to the desired length. A conventional wheel-type cutting blade, generally regarded as somewhat safer but slower than a guillotine-type blade, may be substituted for the guillotine blade 75, if desired. The cutting station 74 includes a conventional control mechanism for actuating the blade 75 when the desired amount of fabric has been fed out onto the feed table 70 and after the conveyor belts 72 have come to a stop. Such control mechanism may be responsive to the stopping of the conveyor belts 72, or may be operated responsive to the lapse of a predetermined time after the servo-controlled drive rollers 66, 68 have stopped.

A transfer station 76 is disposed adjacent the feed table 70 for directing a workpiece from the feed table onto a belt conveyor 77 running in a direction indicated by the arrow 78, which direction is perpendicular to the direction in which fabric is fed from the feed-to-length station 64. The transfer station 76 includes a pneumatic gripper 79 for pulling material from the feed table 70 onto the belt conveyor 77. The transfer station includes a conventional control mechanism for actuating the gripper 79 after the blade 75 has been actuated.

Disposed along the belt conveyor 77 is a rear sewing station 80 comprising a pair of overedge sewing machines 81, 82 located on opposite sides of the belt conveyor. As will be appreciated by those skilled in the art, such machines operate continuously, and sequentiallsewn workpieces are linked together by the continuous thread chain. Accordingly, the rear sewing station 80 further comprises thread chain cutters (not shown), a number of conventional designs of which are well-known, disposed at the rear of each of the sewing machines 81, 82 to cut the thread chain of a workpiece emerging from the machines.

The belt conveyor 77 terminates at a runout table 84. A stacker 86 of conventional design is disposed to transport a workpiece from the runout table 84 onto a stack accumulator 88. The stacker 86 advantageously comprises a pneumatic gripper actuated by photoelectric cells positioned to be triggered by the leading edge of a workpiece being conveyed along the runout table 84. Upon the photoelectric cells being triggered, the gripper grasps the edge of a workpiece and pulls it onto the stack accumulator 88 in the manner well known to those skilled in the art.

Referring now to FIG. 2, the drive mechanism 56 of the material pull station is shown in more detail. A shaft 92 driven in the direction indicated by the arrow 93 by an electric motor or other appropriate drive mechanism (not shown) has a pulley 94 on one end thereof. One side 96 of a double-sided timing belt 97 is engaged by the pulley 94, driving the timing belt in the direction indicated by the arrows 98. The same side 96 of the timing belt 97 engages an idler pulley 100 mounted on the end of a pivotable arm 101 pivotable about a pin 102. The timing belt 97 next passes around a pulley 104 on the end of the axle 105 of the upper drive roller 52, which axle 105 is journaled on a second arm 106 pivotable about a pin 107. The timing belt 97 drives the upper roller in the direction indicated by the arrow 108. The opposite side 109 of the double-sided timing belt 97 drives a pulley 110 on the end of the axle 111 of the lower drive roller 54, driving it in a direction counter to the direction of rotation of the upper roller 52. The pulleys 104, 110 on the ends of the upper and lower rollers 52, 54 have a gear ratio of 1:1, that is to say, they have the identical number of gear teeth, so that the belt 97 drives both rollers to rotate at equal speeds.

An upper pneumatic cylinder 112 operatively associated with the pivotable arm 106 exerts sufficient downward force on the arm to maintain the proper pressure between the upper and lower drive rollers. A lower pneumatic cylinder 113 operatively associated with the pivotable arm 101 exerts sufficient downward pressure on the idler gear 100 to maintain the desired tension on the timing belt 97.

The upper and lower cylinders 112, 113 are advantageously hooked up in series to work in concert to lift and lower the upper drive roller 52. When it is necessary to separate the upper and lower drive rollers, as when initially feeding material between the rollers, the upper cylinder 112 is actuated to retract its rod, lifting the upper roller away from the lower roller. Simultaneously, the lower cylinder 113 is actuated to extend its rod, pivoting the arm 101 upwardly and lifting the idler pulley 100 to provide sufficient play in the timing belt 97 to permit the upper roller to be lifted. Conversely, when it is desired to lower the upper roller, the upper cylinder 112 is actuated to extend its rod, pivoting the arm 106 downwardly and lowering the upper roller against the lower roller. Concurrently therewith, the lower cylinder 113 is actuated to retract its rod, pivoting the arm 101 downwardly and lowering the idler pulley 100 to regain the proper tension in the timing belt 97.

The advantage of a drive mechanism where both the upper and lower rollers are driven to pull the layers of fabric rather than one driven roller and an idler roller, is that it avoids the problem of slippage between the layers of fabric. As will be appreciated by those skilled in the art, with only one driven roller, if the coefficient of friction between the layers of fabric is lower than the coefficient of friction between either layer of fabric and its corresponding roller, slippage of the layers of fabric relative to one another will result. By driving both rollers, the possibility of such slippage is eliminated. The advantage of the disclosed drive mechanism is that counterrotation of the upper and lower rollers at identical rotational speeds is achieved in a compact arrangement having a minimum of moving parts.

The feed-to-length station 64 includes a drive arrangement for driving the rollers 66, 68 similar to the drive mechanism 56 of the feed-to-length station 50, as shown in FIG. 2, with the exception that the rollers of the feed-to-length station are not continuously driven but rather are servo-controlled to operate periodically and for only a predetermined number of rotations.

To set up the apparatus 10 for manufacturing pillowcases, first and second rolls of fabric 16, 32 are mounted on the spindles 14, 30 of the two frames 12, 28 for rotation thereon. For fabrics having finished and unfinished surfaces, such as printed fabrics or fabrics with a nap, the rolls should be installed so that the finished surface is facing upwardly as the fabric is drawn off of the roll. The first or upper layer of fabric 20 is drawn off the first roll 16 and fed through the first chain stitch machine 26. Similarly, the second or lower layer of fabric 34 is drawn off the second roll 32 and fed through the second chain stitch machine 39. The first or upper layer of fabric 20 is pulled around the breakover bar 42, and the first and second layers of fabric are fed together in mutually facing superposition through the overedge sewing machine.

The two superimposed layers are then fed through the pull station 50. To accomplish this, the lower pneumatic cylinder 113 is actuated to raise the pivotable arm 101. The idler gear 100 is thereby raised to provide slack in the drive belt 97. Concurrently therewith, the upper pneumatic cylinder 112 is actuated to lift the pivotable arm 106, thereby raising the upper drive roller 52. When the layers of fabric have been threaded between the rollers, the upper pneumatic cylinder 112 is actuated to lower the upper drive roller 52 against the lower drive roller 54. Simultaneously, the lower pneumatic cylinder 113 is actuated to lower the idler pulley 100, taking up the slack in the drive belt 97 and maintaining the desired degree of tension thereon.

After being fed through the pull station 50, the superimposed layers of fabric 20, 34 are threaded between the rollers 66, 68 of the feed-to-length station 74 in a similar manner. With the fabric installed on the apparatus in the manner indicated, the apparatus is ready to be started.

Referring now to the operation of the pillowcase manufacturing apparatus 10, the first or upper layer of fabric 20 is drawn off the first roll 16 with its obverse surface 21 disposed upwardly. The lateral edge 25 of the first layer 20 is drawn in the direction indicated by the arrow 24 through the chain-stitch sewing machine 26. As the lateral edge 25 of the fabric layer 20 is drawn through the first chain-stitch machine 26, the hem-turning attachment folds the lateral edge under onto the reverse surface 22 of the upper layer to form a continuous cuff 120, and the chain-stitch machine 26 sews the cuff in place with stitches 121.

Concurrently with this operation, the second or lower layer of fabric 34 is drawn off the second roll 32 and conveyed along its predetermined path in the direction indicated by the arrow 37 with its obverse surface 35 disposed upwardly. As described above with respect to the first layer 20, a cuff is formed along the lateral edge 38 of the second layer of fabric 34, and the second chain-stitch machine 39 sews the cuff in place with stitches 123.

At this point, both layers of fabric 20, 34 are being conveyed along their respective paths with the obverse surfaces 21, 35 facing upwardly. In order to bring the two layers of fabric together with their obverse surfaces 21, 35 mutually facing, the upper layer of fabric 20 is drawn around the breakover bar 42, reversing the upper layer of fabric from an obverse-side up orientation to a reverse-side up orientation. As the upper layer 20 passes around the breakover bar 42, it is brought into contact with the lower layer of fabric 34. The upper and lower layers of fabric 20, 34 are thus disposed with their obverse surfaces 21, 35 mutually facing. Additionally, the cuffed lateral edges 25, 38 of the upper and lower layers of fabric are mutually corresponding.

The upper and lower layers of fabric 20, 34 are then conveyed together along a coincident path in the direction indicated by the arrow 44. The superimposed upper and lower layers 20, 34 are fed through the overedge sewing machine 48 to stitch the upper and lower layers of fabric together along their lateral edges 124 opposite the cuffed lateral edges 25, 38. The joined upper and lower layers of fabric 20, 34 are then drawn through the material pull station 50 by the upper and lower rollers 52, 54. The joined layers of fabric are accumulated in the fabric accumulator station 62.

At regular intervals, the servo-controlled drive rollers 66, 68 of the feed-to-length station 64 are actuated to feed a predetermined length of the joined upper and lower layers of fabric from the accumulator station 62, through the cutting station 74, and onto the feed table 70 in the direction indicated by the arrow 73. When the desired length of fabric has been fed out onto the feed table 70, the guillotine blade 75 of the cutting station 74 is actuated to cut the fabric into a rectangular workpiece 130.

The rectangular workpiece 130 so formed comprises upper and lower fabric panels stitched together along one transverse edge 131 and cuffed at the opposite transverse edge 132. The rectangular workpiece also includes opposing lateral edges 133, 134.

The pneumatic gripper 79 of the transfer station 76 grasps the transverse edge 131 of the rectangular workpiece 130 and pulls it onto the belt conveyor 77. The belt conveyor 77 conveys the rectangular workpiece 130 in a direction indicated by the arrow 78 which is generally perpendicular to the transverse edges 131, 132 and parallel to its longitudinal edges 133, 134 of the workpiece. The belt conveyor 77 draws the rectangular workpiece 130 through the rear sewing station 80, where the overedge sewing machines 81, 82 disposed along opposite sides of the workpiece stitch the upper and lower panels of fabric together along their corresponding longitudinal edges 133, 134. After the workpiece is stitched, the thread chain linking the workpiece with the succeeding workpiece is cut by the thread-chain cutter. The stitched workpiece 130 is then fed onto the runout table 84, whence the workpiece is fed by the stacker 86 onto the stack accumulator 88.

The finished workpiece 130 is thus stitched together along both longitudinal edges 133, 134 and one transverse edge 131 and is open at the opposite cuffed transverse edge 132. As fed onto the stack accumulator 88, the panels of the workpiece 130 are disposed reverse-sides out, with the seams exposed. The remaining production step, that of turning the workpiece 130 inside-out such that the obverse surfaces of the fabric face outwardly and the seams are hidden, can be performed manually or with a turning apparatus of conventional design.

As will be appreciated by those skilled in the art, only one side of a chain stitch has an aesthetically pleasing appearance, the opposite side of the stitch having a generally unpleasing aspect. By forming and stitching the cuffs on both the upper and lower layers of fabric 20, 34 with the obverse surfaces of the fabric layers disposed upwardly, the aesthetic side of the chain stitch will be exposed to view on the finished pillowcase.

FIG. 3 shows a schematic diagram of a preferred construction for forming a cuff. The lateral edge 150 of a layer of fabric 152 is folded under along a line 154 by approximately one quarter of an inch to form a hem, and the hemmed edge is then folded along a line 156 under onto the reverse surface 158 of the layer of fabric approximately two inches to form the cuff 160. The cuff 160 is then sewn to the reverse surface 158 of the layer of fabric 152 by stitches 162 to secure the cuff in place. The cuff construction depicted in FIG. 3 is the structure formed by the chain-stitch machines 26, 36 with hem-turning attachments previously disclosed.

In an alternate construction of a cuff 170, shown schematically in FIG. 4, the cuff is formed around the lateral edge 172 of a layer of fabric 174 from a separate piece of fabric 176 stitched to the layer. The cuff 170 is secured in place by stitches 180. While the cuff construction of FIG. 4 is somewhat more difficult to achieve than the simple fold depicted in FIG. 3, forming the cuff from a separate piece of material permits one fabric to be used for the body of the pillowcase and a different complementary fabric to be used for a contrasting cuff.

With either cuff design, piping may optionally be added along the seam of the cuff prior to stitching, to highlight the cuff for ornamental purposes.

In the disclosed embodiment, the first and second layers of fabric are drawn along their respective paths by a set of drive rollers. However, it will be understood that other means for conveying the fabric layers along their respective paths, such as opposing, counterrotating belt conveyors, may be employed without departing from the scope of the present invention. Similarly, while in the disclosed embodiment the first and second layers of fabric are both conveyed along their respective paths by a single set of drive rollers, the present invention contemplates that a separate drive means may be employed for each layer of fabric, if so desired.

Also, in the disclosed embodiment the breakover bar not only reverses the upper layer of fabric from obverse-side up to reverse-side up, but also brings the upper layer of fabric into intimate contact with the lower layer of fabric. It will be understood, however, that these two functions can be performed by separate means, if desired. For example, the reversal of the upper layer of fabric may take place in spaced-apart relation to the lower layer of fabric, and the two layers can subsequently be superimposed by passing them together around a single roller or between a pair of rollers prior to stitching the two layers of fabric together.

The method and apparatus hereinabove described is disclosed with respect to a pillowcase wherein the closed transverse edge is chain-stitched. It will be appreciated by those skilled in the art that other stitches can be used to close the transverse edge of a pillowcase, such as a lockstitch. However, since a lockstitch requires a bobbin which must be rethreaded after a relatively short period of time, requiring the operation of the apparatus to be periodically discontinued while the bobbin is rethreaded, the lockstitch does not lend itself to continuous production, hence the preference for the chainstitch.

Also, the present invention overcomes one disadvantage associated with the chainstitch, namely, the conventional practice of backstitching at the edges of the workpiece to prevent the chainstitch from becoming unraveled. The present method obviates the necessity for backstitching, since the subsequent overedging of the longitudinal edges of the workpiece secures the edges of the chainstitch and prevents the chainstitch from unraveling.

While the foregoing process has been described with respect to a sequence of steps performed on a given section of fabric, it will be understood that the process of the present invention is continuous. In other words, the steps are all being performed concurrently on different portions of the fabric. For example, the upper and lower layers of fabric are being continuously drawn along their respective paths, cuffed, and stitched together to superimpose the layers. At the same time, while one workpiece is being stacked onto the stack accumulator, a following workpiece is being fed through the rear sewing station, another following workpiece is being drawn off the feed table onto the conveyor, and a following length of the superimposed layers of fabric is being fed out onto the feed table to be cut into a workpiece. Thus, while the steps are performed on a particular piece of fabric in a sequential manner, the steps are nonetheless all being performed concurrently with one another on different sections of the fabric.

Finally, it will be understood that the preferred embodiment of the present invention has been disclosed by way of example, and that other modifications may occur to those skilled in the art without departing from the scope and spirit of the appended claims.

What is claimed is:

1. An apparatus for constructing a pillowcase or the like, comprising:

means for conveying an upper layer of fabric having obverse and reverse surfaces and being of indeterminate length along a first predetermined path with its obverse surface facing upwardly, and for conveying a lower layer of fabric having obverse and reverse surfaces and being of indeterminate length along a second predetermined path with its obverse surface facing upwardly;

means for forming a first cuff along a first lateral edge of said upper layer of fabric;

means disposed along said first predetermined path for stitching said first cuff to said first lateral edge of said upper layer of fabric;

means for forming a second cuff along a first lateral edge of said lower layer of fabric;

means disposed along said second predetermined path for stitching said second cuff to said first lateral edge of said lower layer of fabric;

means for reversing said upper layer of fabric so that its obverse surface faces downwardly and for bringing said upper and lower layers of fabric together with their obverse sides mutually facing and their first cuffed lateral edges mutually corresponding;

means for conveying said mutually facing upper and lower layers of fabric together along a third predetermined path;

means disposed along said third predetermined path for stitching said upper and lower layers of fabric together along the second lateral edges of said layers of fabric opposite said first cuffed lateral edges;

means for measuring said indeterminate length upper and lower layers of fabric to a predetermined length substantially equal to the desired width of a finished pillowcase;

means for cutting said upper and lower layers of fabric perpendicular to said first and second lateral edges at said predetermined length to form a rectangular unitary workpiece comprising upper and lower panels of fabric having obverse surfaces in mutually facing superposition, said panels being stitched together along one transverse edge and cuffed at their opposite transverse edge, and the remaining two edges of said rectangular unitary workpiece comprising longitudinal edges;

means for conveying said rectangular unitary workpiece along a fourth predetermined path parallel to said longitudinal edges of said rectangular unitary workpiece; and means disposed along said fourth predetermined path for stitching said upper and lower panels of said rectangular unitary workpiece together along said longitudinal edges of said rectangular unitary workpiece, whereby said rectangular unitary workpiece is stitched together along both longitudinal edges and one transverse edge and is open at the opposite cuffed transverse edge.

2. The apparatus of claim 1, wherein said means for stitching said first cuff to said first lateral edge of said upper layer of fabric and said means for stitching said second cuff to said first lateral edge of said lower layer of fabric comprise chain-stitch sewing machines.

3. The apparatus of claim 1, wherein said means for stitching said upper and lower layers of fabric together along the second lateral edges of said layers of fabric opposite said first cuffed lateral edges and said means for stitching said upper and lower panels of said rectangular unitary workpiece together along said longitudinal edges of said rectangular unitary workpiece comprise overedge sewing machines.

4. The apparatus of claim 1, wherein said means for forming said first cuff along said first lateral edge of said upper layer of fabric and said means for forming said second cuff along said first lateral edge of said lower layer of fabric comprise a hem-turning apparatus.

5. The apparatus of claim 1, wherein said means for reversing said upper layer of fabric so that its obverse surface faces downwardly and for bringing said upper and lower layers of fabric together with their obverse sides mutually facing and their first cuffed lateral edges mutually corresponding comprises a breakover bar disposed along said first predetermined path.

6. The apparatus of claim 1, wherein said means for reversing said upper layer of fabric so that its obverse surface faces downwardly and for bringing said upper and lower layers of fabric together with their obverse sides mutually facing and their first cuffed lateral edges mutually corresponding comprises:

a first means for reversing said upper layer of fabric so that its obverse surface faces downwardly; and a second means for bringing said upper and lower layers of fabric together with their obverse sides mutually facing and their first cuffed lateral edges mutually corresponding.

7. The apparatus of claim 1, wherein said means for measuring said indeterminate length upper and lower layers of fabric to a predetermined length substantially equal to the desired width of a finished pillowcase comprises:

upper and lower tangential rollers for conveying said upper and lower layers of fabric therebetween; and means for controlling said upper and lower tangential rollers to rotate to convey only said predetermined length of fabric therethrough and to stop rotating when said predetermined length of fabric has been conveyed therethrough.

8. The apparatus of claim 7, further comprising means responsive to said predetermined length of fabric having been fed through said upper and lower tangential rollers for actuating said cutter.

* * * * *